United States Patent [19]

Roberts

[11] Patent Number: 4,640,348

[45] Date of Patent: Feb. 3, 1987

[54] DUAL PURPOSE CLOSURE FOR HEAT EXCHANGERS

[76] Inventor: W. F. Roberts, 4731 S. Columbia Pl., Tulsa, Okla. 74105

[21] Appl. No.: 792,278

[22] Filed: Oct. 25, 1985

Related U.S. Application Data

[60] Division of Ser. No. 641,865, Aug. 17, 1984, Pat. No. 4,564,065, which is a continuation-in-part of Ser. No. 551,573, Nov. 14, 1983, Pat. No. 4,570,701.

[51] Int. Cl.[4] ..... F28F 9/02

[52] U.S. Cl. ..... 165/158; 285/133.1; 285/368

[58] Field of Search ..... 165/158, 154, 143; 285/133.1, 137.1, 363, 368

[56] References Cited

U.S. PATENT DOCUMENTS

| | | | |
|---|---|---|---|
| 1,834,968 | 12/1931 | Rector | 285/133 A |
| 2,449,052 | 9/1948 | Brown, Jr. . | |
| 2,520,755 | 8/1950 | Brown, Jr. . | |
| 3,018,090 | 1/1962 | Kaase et al. . | |
| 3,079,992 | 3/1963 | Otten et al. . | |
| 3,155,404 | 11/1964 | Brown et al. | 165/158 |
| 3,249,153 | 5/1966 | Holland . | |
| 3,377,087 | 4/1968 | Samerdyke et al. | 165/158 |
| 3,424,480 | 1/1969 | Holland . | |
| 3,526,275 | 9/1970 | Vance et al. | 165/162 |
| 3,593,782 | 7/1971 | Draves . | |
| 4,156,457 | 5/1979 | Murray | 165/158 |

FOREIGN PATENT DOCUMENTS

| | | | |
|---|---|---|---|
| 2162903 | 6/1923 | Fed. Rep. of Germany | 285/368 |
| 677180 | 8/1952 | United Kingdom | 285/368 |

OTHER PUBLICATIONS

R. W. Holland Company, Inc. brochure dated 7/30/79 (pp. 1, 2, 11 and inside back page).

Thermal Fin Tube International brochure, Form E7-8-M1U/M1S, no date.

*Primary Examiner*—Albert W. Davis, Jr.

*Attorney, Agent, or Firm*—Head, Johnson & Stevenson

[57] ABSTRACT

Closures for double pipe and hairpin-type heat exchangers that permits opening the tube side of the closure without losing the shell side fluids or seal. A threaded thrust ring is positioned between the shell side flange and the tube side flange and integrally connected with the tube sheet. Each connection bolt through the flange has a shoulder or threads interconnecting with the thrust ring for applying a force to maintain the seal between the shell side flange and the tube sheet.

4 Claims, 5 Drawing Figures

DUAL PURPOSE CLOSURE FOR HEAT EXCHANGERS

RELATED APPLICATION

This is a divisional application of Ser. No. 641,865, filed Aug. 17, 1984 now U.S. Pat. No. 4,564,065 granted Jan. 14, 1984 which is a continuation-in-part of Ser. No. 551,573, filed Nov. 14, 1983 now U.S. Pat. No. 4,570,701 granted Feb. 18, 1986.

SUMMARY OF THE INVENTION

A primary object of this invention is to provide a closure for double pipe and hairpin heat exchangers that permits the tube side of the closure to be opened for maintenance and/or repair without losing the shell side fluids seal and has particular adaptability to situations where the shell side fluids are of hazardous or corrosive fluids.

In particular, the closure is directed to use with heat exchangers of the type having a shell side enclosure and at least one tube within the shell. That is, heat exchangers of the hairpin type having one single tube or a plurality of tubes therein. The closure comprises a shell side flange attached to the end of the shell and a tube sheet encompassing the tube or tubes and situated within the shell adjacent the end to be closed. The tube sheet has peripheral threads therein. A tubular connection formed of a tube and flange is provided in facing alignment with a thrust flange and the shell flange. The thrust flange of the invention is threaded and is positionable between the shell and tube flanges. The thrust flange surrounds the tube sheet and includes peripheral threads for interconnection with the threads on the tube sheet. Seals are provided between the tube sheet and the shell flange and between the tube flange and the tube sheet. A plurality of axially aligned openings are provided in the shell, tube and thrust flanges to receive connection bolts which are used to assemble the closure. Interconnection is made between the bolts and the thrust flange by a variety of mechanisms including a threaded connection, a nut or sleeve abuttable against the thrust flange for drawing the thrust and shell flanges together.

Another object of the invention is to provide a closure that will allow separate hydrostatic testing of the shell side with the tube side flange removed and/or hydrostatic testing of the tube bundle when removed from the shell.

DETAILED DESCRIPTION OF THE PREFERRED EMBODIMENT

Figure 1:
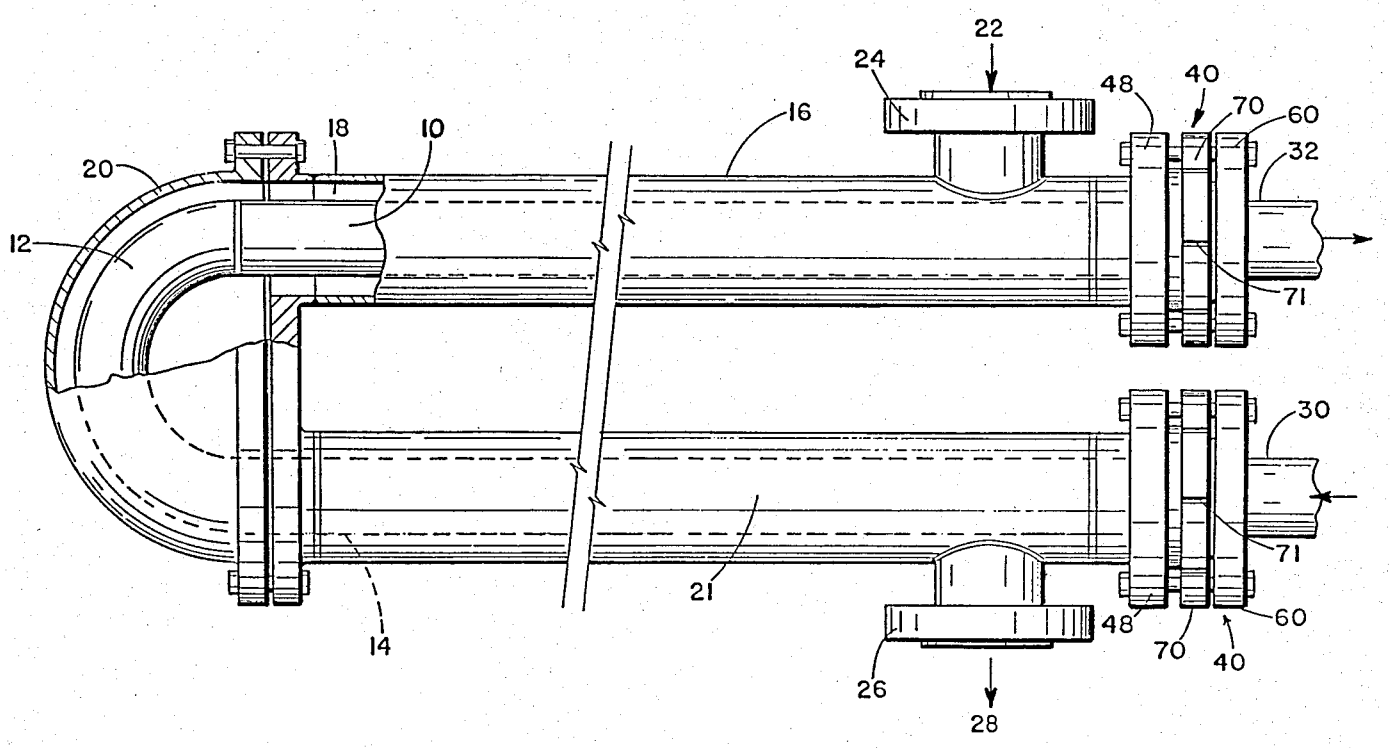
FIG. 1 is elevation, partly in section, of a hairpin-type heat exchanger which includes in this embodiment a single inner tube surrounded by an outer tube or shell, which heat exchanger includes closure elements constructed in accordance with this invention.

The heat exchanger exemplified in FIG. 1 is of the hairpin-type comprising a straight tube 10, a return bend 12 connecting with another straight tube 14 shown in dotted line. Although a single tube construction has been shown, the invention herein encompasses the use of a plurality or bundle of hairpin-shaped tubes. The inner tube is enclosed by a substantially co-axial shaped shell 16 defining the shell side space 18. The shell includes a similar return bend portion 20 interconnecting with straight shell 21. The shell side fluids 22 are caused to flow through inlet connection 24 with their exit therefrom through outlet 26 as shown by arrow 28. The tube side fluids are caused to enter through tubing 30 and exit through tubing 32. The direction of flow of fluids is not critical to this invention. The closure of this invention for effecting a seal between the shell side and the tube side is identical for both the inlet and outlet and is generally designated by the numeral 40.

Figure 2:
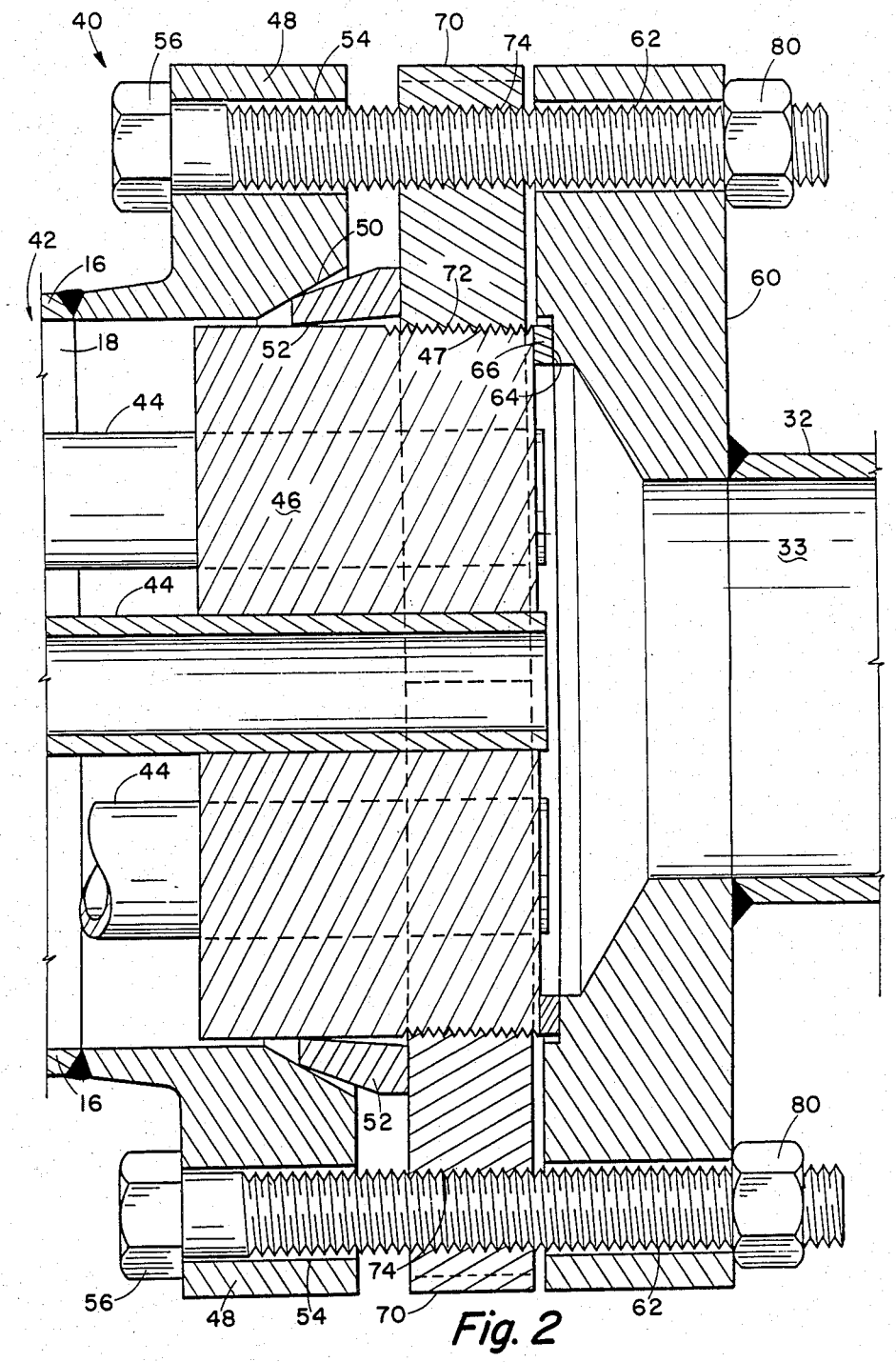
FIG. 2 is a vertical longitudinal section view through a closure embodying this invention.
Figure 3:
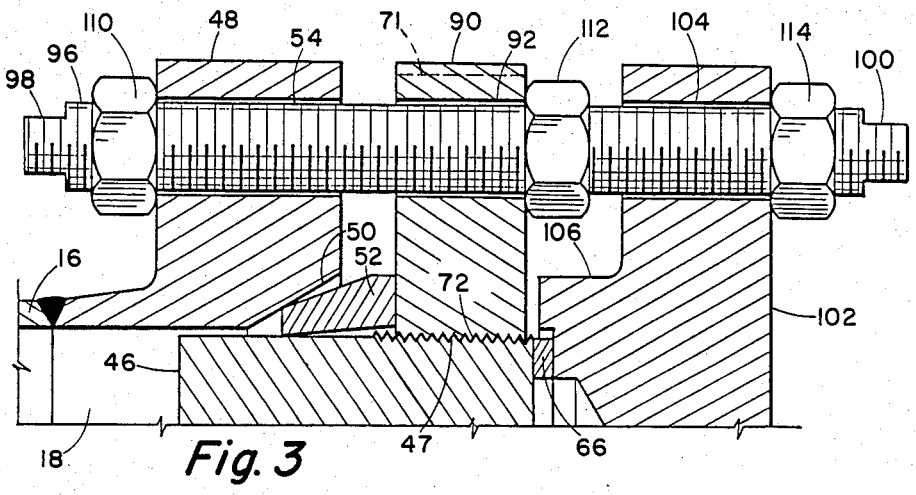
FIGS. 3, 4 and 5 are partial sectional views of alternate embodiments incorporating the concepts of the invention.
Figure 4:
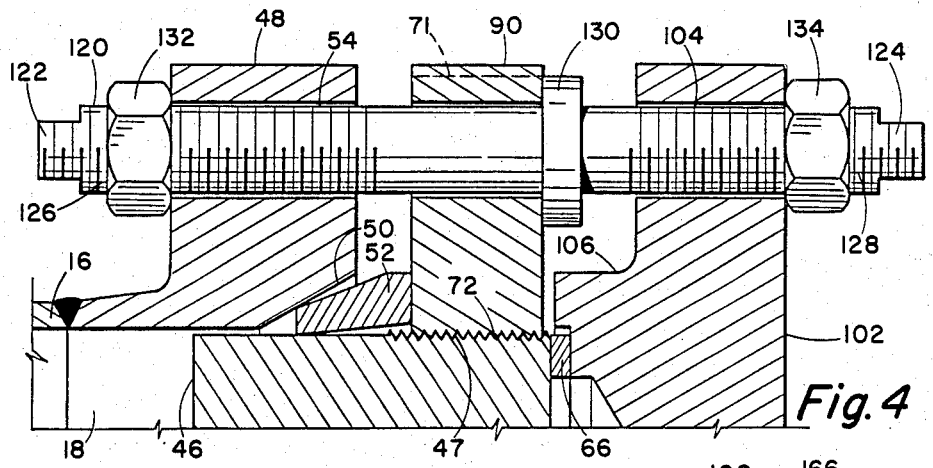
Figure 5:
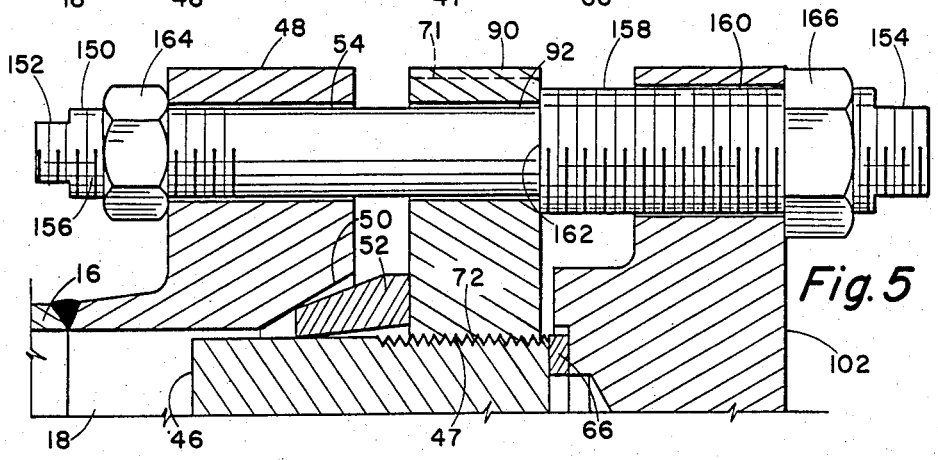

In FIG. 2, the closure 40 of this invention is specifically described relative to a bundle of tubes generally at 42 comprised of a plurality of tubes 44, which are encompassed by a tube sheet 46. The tube sheet 46 is situated adjacent the end of the shell 16 and shell flange 48. The flange may include an interior bevel surface 50 to accomodate or receive a seal ring 52, which may be of any suitable type as known in the art. The purpose being to provide a wedge surface abuttable against the beveled surface 50 to seal the shell side fluids between the space 18 and the tube sheet 46. The shell flange includes a plurality of circumferentially spaced openings 54 to receive a threaded bolt 56 or stud bolt such as shown in FIGS. 3, 4 and 5. The tubular connection 32 includes a tube flange 60 which faces, in alignment with the shell flange 48 and includes a plurality of circumferentially spaced openings 62, which when the closure is assembled, are in axial alignment with the openings 54 of the shell flange 48 for receiving longitudinal bolts or studs 56 therethrough. The tube flange 60 includes an inset 64 to receive a seal ring 66 and thus seal the interior space 33 of the tube 32. A thrust flange 70, with wrench grooves 71, is positionable between the shell flange 48 and the tube flange 60. The thrust flange surrounds the tube sheet 46 and includes inner peripheral threads 72 for interconnection with the threads 47 formed in the periphery of tube sheet 46. The thrust flange includes a plurality of axially aligned openings 74 in this embodiment threaded to accept and receive the threaded portion of bolt 56. The closure is assembled by inserting the seal ring 52 into position relative to the beveled recess 50 about the tube sheet 46. Thrust ring 70 is then threadably interconnected to the tube sheet and bolts 56 are threaded thereto which, upon rotation, will draw the thrust ring 70 toward the shell flange 48 compressing the ring 52 to seal the shell side space between the tube sheet 46 and shell 16 and its attached flange 48. Thereafter the tube 32 and its associated tube flange 60 are positioned with the bolts 56 extending therethrough openings 62. A nut 80 is threaded to the exposed end, compressing seal 66, which has been previously positioned and thus providing a compressive connection to assembly the closure.

In the event it is desirable to repair, inspect and/or clean the interior of the tubes 44, nuts 80 are removed allowing the tube 32 and its associated flange 60 to be removed. In most heat exchange connections there is a spaced connection with tubing 32, not shown, which upon disconnecting allows the removal of the tubing stub or spool 32 and flange 60 for access to the tubing interior.

The embodiment of FIG. 3 is substantially identical to the major components shown in FIG. 2 with like parts utilizing like numerals. Tube sheet 46 includes outer peripheral threads 47 therein to accept threaded thrust ring 90 which, in this embodiment, includes a plurality of axially aligned openings 92 to receive the threaded stud 96. The threaded stud includes flattened end portion 98 and 100 for a wrench or other tools. Tube flange 102 includes a plurality of circumferential spaced axial openings 104 and in this embodiment, a recess 106. During the assembly thereof the threaded stud 96 is inserted through the openings 54 and 92 of the respective shell flange 48 and thrust flange 90. Nut 110 is threaded upon the stud to abut against the outside of shell flange 48. Nut 112 is threaded upon the stud 96 to abut against the thrust flange 90. By turning one or both of nuts 110 and 112 relative to stud 96 the thrust flange 90 is caused to draw towards the shell flange and seal the shell side space 18 as previously described. Tube flange 102 is assembled with the studs 96 projecting therethrough. Nuts 114 are threaded upon the studs 96 to abut against the tube flange 102 for the assembly as similarly described to compress seal ring 66 between the tube flange 102 and the tube sheet 46.

In the embodiment of FIG. 4 the respective shell flange 48, thrust flange 90 and tube flange 102 are essentially identical to that shown in FIG. 3. The change is directed to the bolt or stud 120 which includes flats or wrench surfaces 122 on one end and 124 on the other. In this embodiment there is a threaded section 126 adjacent the shell flange end and a threaded portion 128 adjacent to the tube flange end. An enlarged sleeve 130 formed as a part of the stud abuts against the thrust flange 90 as shown. In the assembly the thrust flange and assembled tube sheet 46 is caused to move toward the shell flange by the relative rotation of nut 132 to stud 120, drawing the two together and causing compression of the sealing ring 52 against the beveled surface 50 and the tube sheet 46 to seal the shell side space 18. Thereafter the tube flange 102 is assembled using nuts 134 to compress the seal ring 66 against the tube sheet 46.

A further embodiment is shown in FIG. 5, the only change being in the bolt or stud 150, having a wrench or flat 152 on the shell side and flat 154 on the tube side. In this embodiment the stud 150 includes a threaded portion 156 adjacent the shell flange 48 side. The threaded portion 156 extends through the thrust ring 90 to an enlarged threaded portion 158. The tube flange 102 has enlarged openings 160 to receive the larger diameter portion 158. The enlarged threaded portion includes a shoulder 162 for abutment against the thrust flanges 90. The assembly is similar to that in FIG. 4, wherein nuts 164 operating against the shell flange 48 will draw the thrust flange 90 toward the shell flange 48 perfecting the seal as previously described. Thereafter nut 166 will draw the tube flange 102 toward the tube sheet 46 compressing sealing ring 66 therebetween. Tube flange 102 does not necessarily need to be recessed as shown at 106 of FIG. 4.

What is claimed is:

1. An end closure for a heat exchanger of the type having a shell side enclosure and at least one tube within said shell, the closure comprising a shell flange attached to the end of said shell, a tube sheet encompassing said tube and situated within said shell adjacent said end, said tube sheet having peripheral threads, a tubular connection and a tube flange for said tubular connection, said tube flange in facing alignment with said shell flange, a thrust flange positionable between said shell flange and said tube flange, said thrust flange surrounding said tube sheet and including inner peripheral threads for interconnection with said tube sheet threads, a plurality of axially aligned openings in said shell, tube and thrust flanges to receive connection bolts or studs to assemble said closure, an enlarged means on a plurality of said bolts or studs abuttable against said thrust flange, means to seal between said tube sheet and said shell flange, and means to seal between said tube flange and said tube sheet.

2. An end closure of claim 1 wherein said enlarged means is a threaded nut.

3. An end closure of claim 1 wherein said enlarged meabs is an enlarged sleeve formed as a part of said bolt or stud.

4. An end closure of claim 3 wherein said enlarged sleeve is threaded.

* * * * *